US011062844B2

(12) United States Patent
Kuniyoshi et al.

(10) Patent No.: US 11,062,844 B2
(45) **Date of Patent: *Jul. 13, 2021**

(54) METHOD OF PRODUCING R-T-B SINTERED MAGNET

(71) Applicant: HITACHI METALS, LTD., Tokyo (JP)

(72) Inventors: Futoshi Kuniyoshi, Minato-ku (JP); Shuji Mino, Minato-ku (JP)

(73) Assignee: HITACHI METALS, LTD., Tokyo (JP)

( * ) Notice: Subject to any disclaimer, the term of this patent is extended or adjusted under 35 U.S.C. 154(b) by 237 days.

This patent is subject to a terminal disclaimer.

(21) Appl. No.: 16/322,755

(22) PCT Filed: Jul. 28, 2017

(86) PCT No.: PCT/JP2017/027518
§ 371 (c)(1),
(2) Date: Feb. 1, 2019

(87) PCT Pub. No.: WO2018/030187
PCT Pub. Date: Feb. 15, 2018

(65) Prior Publication Data

US 2019/0214192 A1 Jul. 11, 2019

(30) Foreign Application Priority Data

Aug. 8, 2016 (JP) ..... JP2016-155761

(51) Int. Cl.
*H01F 41/02* (2006.01)
*B22F 3/24* (2006.01)
(Continued)

(52) U.S. Cl.
CPC ..... *H01F 41/0293* (2013.01); *B22F 3/00* (2013.01); *B22F 3/24* (2013.01); *C22C 28/00* (2013.01);
(Continued)

(58) Field of Classification Search
CPC ..... H01F 41/0293; H01F 1/0536
See application file for complete search history.

(56) References Cited

U.S. PATENT DOCUMENTS

2008/0245442 A1 10/2008 Nakamura et al.
2010/0282371 A1 11/2010 Sagawa et al.
(Continued)

FOREIGN PATENT DOCUMENTS

CN 105051844 A 11/2015
JP 2008-263179 A 10/2008
(Continued)

OTHER PUBLICATIONS

JP-2012234971-A English translation (Year: 2020).*
(Continued)

*Primary Examiner* — Nicholas A Wang
*Assistant Examiner* — Jiangtian Xu
(74) *Attorney, Agent, or Firm* — Keating & Bennett, LLP

(57) ABSTRACT

A method for producing a sintered R-T-B based magnet includes applying an adhesive agent to an application area of the magnet, adhering a particle size-adjusted powder of a heavy rare-earth element RH which is at least one of Dy and Tb to the application area, and heating at a temperature which is equal to or lower than a sintering temperature of the magnet to allow the element RH in the particle size-adjusted powder to diffuse from the surface into the interior of the magnet. The particle size of the particle size-adjusted powder is set so that, when powder particles are placed on the entire surface of the magnet to form a single particle layer,
(Continued)

the amount of element RH in the particle size-adjusted powder is in a range from 0.6 to 1.5% with respect to the magnet by mass ratio.

4 Claims, 4 Drawing Sheets

(51) Int. Cl.

| | |
|---|---|
| ***B22F 3/00*** | (2021.01) |
| ***C22C 28/00*** | (2006.01) |
| ***C22C 38/00*** | (2006.01) |
| ***H01F 1/057*** | (2006.01) |
| ***H01F 1/053*** | (2006.01) |

(52) U.S. Cl.
CPC ..... *C22C 38/00* (2013.01); *H01F 1/057* (2013.01); *H01F 1/0536* (2013.01); *H01F 41/02* (2013.01)

(56) References Cited

U.S. PATENT DOCUMENTS

| | | | | |
|---|---|---|---|---|
| 2013/0169394 | A1* | 7/2013 | Sagawa | H01F 41/005 335/302 |
| 2014/0120248 | A1 | 5/2014 | Kuniyoshi | |
| 2016/0297028 | A1 | 10/2016 | Sagawa et al. | |
| 2017/0183765 | A1 | 6/2017 | Mino | |
| 2017/0263379 | A1 | 9/2017 | Mino | |
| 2019/0214191 | A1* | 7/2019 | Kuniyoshi | H01F 41/0253 |

FOREIGN PATENT DOCUMENTS

| | | | | |
|---|---|---|---|---|
| JP | 2012-234971 | A | | 11/2012 |
| JP | 2012234971 | A | * | 11/2012 |
| JP | 2012-248827 | A | | 12/2012 |
| JP | 2012-248828 | A | | 12/2012 |
| WO | 2006/043348 | A1 | | 4/2006 |
| WO | 2009/087975 | A1 | | 7/2009 |
| WO | 2013/002170 | A1 | | 1/2013 |
| WO | 2015/163397 | A1 | | 10/2015 |
| WO | 2016/039353 | A1 | | 3/2016 |

OTHER PUBLICATIONS

Yan (Year: 2011).*
Official Communication issued in International Patent Application No. PCT/JP2017/027518, dated Oct. 17, 2017.

* cited by examiner (a)

(b)

METHOD OF PRODUCING R-T-B SINTERED MAGNET

TECHNICAL FIELD

The present disclosure relates to a method for producing a sintered R-T-B based magnet (where R is a rare-earth element; and T is Fe, or Fe and Co).

BACKGROUND ART

Sintered R-T-B based magnets whose main phase is an $R_2T_{14}B$-type compound are known as permanent magnets with the highest performance, and are used in voice coil motors (VCMs) of hard disk drives, various types of motors such as motors to be mounted in hybrid vehicles, home appliance products, and the like.

Intrinsic coercivity $H_{cJ}$ (hereinafter simply referred to as "$H_{cJ}$") of sintered R-T-B based magnets decreases at high temperatures, thus causing an irreversible thermal demagnetization. In order to avoid irreversible thermal demagnetization, when used in a motor or the like, they are required to maintain high $H_{cJ}$ even at high temperatures.

It is known that if R in the $R_2T_{14}B$-type compound phase is partially replaced with a heavy rare-earth element RH (Dy, Tb), $H_{cJ}$ of a sintered R-T-B based magnet will increase. In order to achieve high $H_{cJ}$ at high temperature, it is effective to profusely add a heavy rare-earth element RH in the sintered R-T-B based magnet. However, if a light rare-earth element RL (Nd, Pr) that is an R in a sintered R-T-B based magnet is replaced with a heavy rare-earth element RH, $H_{cJ}$ will increase but there is a problem of decreasing remanence $B_r$ (hereinafter simply referred to as "$B_r$"). Furthermore, since heavy rare-earth elements RH are rare natural resources, their use should be cut down.

Accordingly, in recent years, it has been attempted to improve $H_{cJ}$ of a sintered R-T-B based magnet with less of a heavy rare-earth element RH, this being in order not to lower $B_r$. For example, one proposal involves: allowing a fluoride or an oxide of a heavy rare-earth element RH, or any of various metals M or M alloys, to be present on the surface of a sintered magnet, either alone by itself or in a mixture; performing a heat treatment in this state; and diffusing within the magnet a heavy rare-earth element RH that will contribute to an improved coercivity.

Patent Document 1 discloses using an R oxide, an R fluoride, or an R oxyfluoride in powder form (where R is a rare-earth element).

Patent Document 2 discloses using a powder of RM (where M is one or more selected from among Al, Cu, Zn, Ga, and the like) alloy.

Patent Documents 3 and 4 disclose that, by using a powder mixture including an RM alloy (where M is one or more selected from among Al, Cu, Zn, Ga, and the like), an M1M2 alloy (where M1M2 is one or more selected from among Al, Cu, Zn, Ga, and the like), and an RH oxide, it is possible to partially reduce the RH oxide with the RM alloy or the like during the heat treatment, thus allowing a heavy rare-earth element RH to be introduced into the magnet.

CITATION LIST

Patent Literature

[Patent Document 1] International Publication No. 2006/043348

[Patent Document 2] Japanese Laid-Open Patent Publication No. 2008-263179

[Patent Document 3] Japanese Laid-Open Patent Publication No. 2012-248827

[Patent Document 4] Japanese Laid-Open Patent Publication No. 2012-248828

[Patent Document 5] International Publication No. 2015/163397

SUMMARY OF INVENTION

Technical Problem

Patent Documents 1 to 4 above disclose methods which allow a powder mixture containing a powder of an RH compound to be present on the entire magnet surface (the entire surface of the magnet) and perform a heat treatment. According to specific examples of these methods, a magnet is immersed into a slurry which is obtained by dispersing the aforementioned powder mixture in water or an organic solvent, and then retrieved (immersion/lifting technique). In the immersion/lifting technique, hot air drying or natural drying is performed for the magnet that has been retrieved out of the slurry. Instead of immersing the magnet into a slurry, spraying a slurry onto a magnet is also disclosed (spray coating technique).

These methods make it possible to apply a slurry on the entire surface of the magnet. Therefore, a heavy rare-earth element RH can be introduced into the magnet through the entire surface of the magnet, thereby providing a greater $H_{cJ}$ improvement after the heat treatment. However, in an immersion/lifting technique, the slurry will inevitably abound below the magnet, owing to gravity. On the other hand, the spray coating technique will result in a large coating thickness at the magnet end, owing to surface tension. Both methods have difficulty in allowing the RH compound to be uniformly present on the magnet surface. This leads to a problem in that the $H_{cJ}$ after heat treatment will considerably fluctuate.

When the coating layer is made thin by using a slurry of low viscosity, nonuniformity in the thickness of the coating layer can be somewhat improved. However, since the applied amount of slurry becomes reduced, the $H_{cJ}$ after the heat treatment cannot be greatly improved. When a plurality of applications are made in order to increase the applied amount of slurry, the production efficiency will be much lowered. In particular, when a spray coating technique is adopted, the slurry will also be applied on the inner wall surface of the spraying apparatus, thus deteriorating the efficiency of use of the slurry. This induces a problem in that the heavy rare-earth element RH, which is a scarce resource, is wasted.

In Patent Document 5, the Applicant discloses a method in which a diffusion heat treatment is performed while an RLM alloy powder and an RH fluoride powder are allowed to be present on the surface of a sintered R-T-B based magnet. There are hardly any well-established methods for allowing these powders to be uniformly present on the surface of a sintered R-T-B based magnet.

The present disclosure provides a novel method in which, when forming a layer of powder particles containing a heavy rare-earth element RH on a magnet surface in order to improve $H_{cJ}$ by diffusing the heavy rare-earth element RH into a sintered R-T-B based magnet, particles of such powders can be uniformly applied on the surface of the sintered R-T-B based magnet efficiently without waste, thus diffusing the heavy rare-earth element RH into the interior from the magnet surface, thereby greatly improving $H_{cJ}$.

Solution to Problem

In an illustrative embodiment, a method for producing a sintered R-T-B based magnet according to the present disclosure comprises: a step of providing a sintered R-T-B based magnet (where R is a rare-earth element; and T is Fe, or Fe and Co); a step of providing a particle size-adjusted powder that is composed of a powder of an alloy or a compound of a heavy rare-earth element RH which is at least one of Dy and Tb; an application step of applying an adhesive agent to an application area of a surface of the sintered R-T-B based magnet; an adhesion step of allowing the particle size-adjusted powder to adhere to the application area of the surface of the sintered R-T-B based magnet having the adhesive agent applied thereto; and a diffusing step of heating the sintered R-T-B based magnet having the particle size-adjusted powder adhering thereto at a temperature which is equal to or lower than a sintering temperature of the sintered R-T-B based magnet to allow the heavy rare-earth element RH contained in the particle size-adjusted powder to diffuse from the surface into the interior of the sintered R-T-B based magnet, wherein the particle size of the particle size-adjusted powder is set so that, when powder particles composing the particle size-adjusted powder are placed on the entire surface of the sintered R-T-B based magnet to form a single particle layer, the amount of heavy rare-earth element RH contained in the particle size-adjusted powder is in a range from 0.6 to 1.5% (preferably, 0.7 to 1.5%) by mass ratio with respect to the sintered R-T-B based magnet.

In another aspect, a method for producing a sintered R-T-B based magnet according to the present disclosure comprises: a step of providing a sintered R-T-B based magnet (where R is a rare-earth element; and T is Fe, or Fe and Co); a step of providing a diffusion source powder that is composed of a powder of an alloy or a compound of a heavy rare-earth element RH which is at least one of Dy and Tb; an application step of applying an adhesive agent to an application area of a surface of the sintered R-T-B based magnet; an adhesion step of allowing the diffusion source powder to adhere to the application area of the surface of the sintered R-T-B based magnet having the adhesive agent applied thereto;

a diffusing step of heating the sintered R-T-B based magnet having the diffusion source powder adhering thereto at a temperature which is equal to or lower than a sintering temperature of the sintered R-T-B based magnet to allow the heavy rare-earth element RH contained in the diffusion source powder to diffuse from the surface into the interior of the sintered R-T-B based magnet, wherein, in the adhesion step, the diffusion source powder adhering to the application area comprises: (1) a plurality of particles being in contact with a surface of the adhesive agent; (2) a plurality of particles adhering to the surface of the sintered R-T-B based magnet via nothing but the adhesive agent; and (3) other particles sticking to one or more particles among the plurality of particles not via any adhesive material.

In one embodiment, in the adhesion step, the diffusion source powder is allowed to adhere to the application area so that the amount of heavy rare-earth element RH contained in the diffusion source powder is in a range from 0.6 to 1.5% with respect to the sintered R-T-B based magnet by mass ratio.

In one embodiment, the thickness of the adhesive layer is not less than 10 μm and not more than 100 μm.

In one embodiment, the adhesion step is a step of allowing the particle size-adjusted powder to adhere to a plurality of regions of different normal directions within the surface of the sintered R-T-B based magnet.

In one embodiment, in the adhesion step, the particle size-adjusted powder is allowed to adhere to the entire surface of the sintered R-T-B based magnet having the adhesive agent applied thereto.

In one embodiment, the particle size-adjusted powder comprises a powder of an RHRLM1M2 alloy (where RH is one or more selected from among Dy and Tb; RL is one or more selected from among Nd and Pr; and M1 and M2 are one or more selected from among Cu, Fe, Ga, Co, Ni and Al, possibly M1=M2).

In one embodiment, the particle size-adjusted powder comprises a powder of an RHM1M2 alloy (where RH is one or more selected from among Dy and Tb; and M1 and M2 are one or more selected from among Cu, Fe, Ga, Co, Ni and Al, possibly M1=M2).

In one embodiment, the particle size-adjusted powder comprises a powder of an RH compound (where RH is one or more selected from among Dy and Tb; and the RH compound is one or more selected from among an RH fluoride, an RH oxyfluoride, and an RH oxide).

In one embodiment, the particle size-adjusted powder comprises a powder of an RLM1M2 alloy (where RL is one or more selected from among Nd and Pr; and M1 and M2 are one or more selected from among Cu, Fe, Ga, Co, Ni and Al, possibly M1=M2).

In one embodiment, the particle size-adjusted powder is a particle size-adjusted powder that has been granulated with a binder.

In one embodiment, the particle size-adjusted powder comprises the powder of RLM1M2 alloy and the powder of RH compound, and comprises the powder of RLM1M2 alloy and the powder of RH compound having been granulated with a binder.

Advantageous Effects of Invention

According to an embodiment of the present disclosure, a layer of powder particles containing a heavy rare-earth element RH can be uniformly applied on the surface of the sintered R-T-B based magnet, efficiently without waste, in order to improve $H_{cJ}$ by diffusing the heavy rare-earth element RH into a sintered R-T-B based magnet. Therefore, while reducing the amount of a heavy rare-earth element RH (which is a scarce resource) to be used, $H_{cJ}$ of the sintered R-T-B based magnet can be improved.

DESCRIPTION OF EMBODIMENTS

An illustrative embodiment of a method for producing a sintered R-T-B based magnet according to the present disclosure includes:

1. a step of providing a sintered R-T-B based magnet (where R is a rare-earth element; and T is Fe, or Fe and Co);

2. a step of providing a diffusion source powder (which may hereinafter be referred to as a "particle size-adjusted powder") that is composed of a powder of an alloy or a compound of a heavy rare-earth element RH (which is at least one of Dy and Tb);

3. an application step of applying an adhesive agent to an application area (which does not need to be the entire magnet surface) of the surface of the sintered R-T-B based magnet;

4. an adhesion step of allowing the particle size-adjusted powder to adhere to an application area of the surface of the sintered R-T-B based magnet having the adhesive agent applied thereto; and 5. a diffusing step of heating the sintered R-T-B based magnet having the particle size-adjusted powder adhering thereto at a temperature which is equal to or lower than the sintering temperature of the sintered R-T-B based magnet, thereby allowing the heavy rare-earth element RH contained in the particle size-adjusted powder to diffuse from the surface into the interior of the sintered R-T-B based magnet.

Figure 1A:
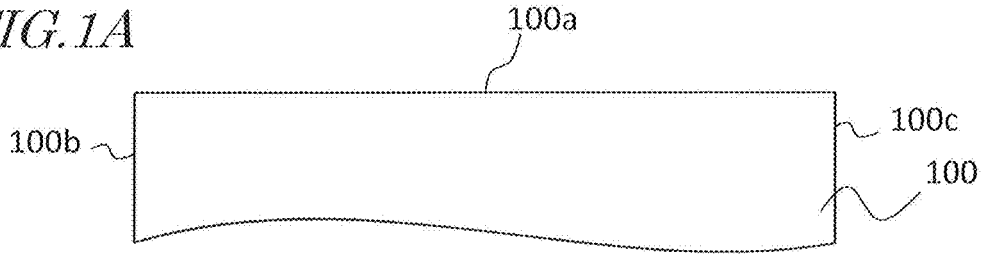
FIG. 1A A cross-sectional view schematically showing a part of a sintered R-T-B based magnet 100 that was provided.

FIG. 1A is a cross-sectional view schematically showing a part of a sintered R-T-B based magnet 100 that may be used in a method for producing a sintered R-T-B based magnet according to the present disclosure. In the figure, an upper face 100*a* and side faces 100*b* and 100*c* of the sintered R-T-B based magnet 100 are shown. The shape and size of the sintered R-T-B based magnet used in the production method according to the present disclosure are not limited to the shape and size of the sintered R-T-B based magnet 100 as illustrated. Although the upper face 100*a* and side faces 100*b* and 100*c* of the illustrated sintered R-T-B based magnet 100 are flat, the surface of the sintered R-T-B based magnet 100 may have rises and falls or stepped portions, or be curved.

Figure 1B:
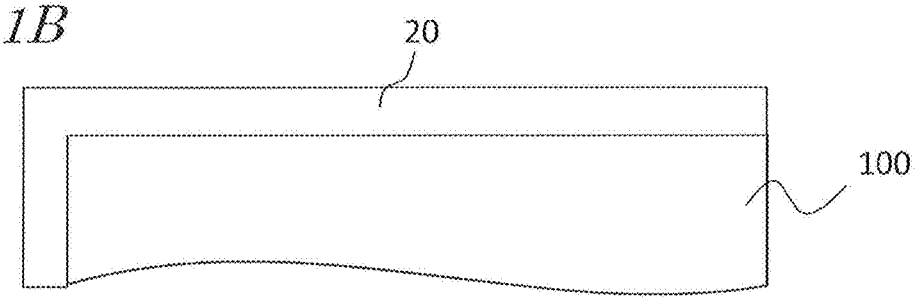
FIG. 1B A cross-sectional view schematically showing a part of a sintered R-T-B based magnet 100 having an adhesive layer 20 formed in a portion of the magnet surface.

FIG. 1B is a cross-sectional view schematically showing a part of the sintered R-T-B based magnet 100 having an adhesive layer 20 formed in a portion (an area for application) of the surface of the sintered R-T-B based magnet 100. The adhesive layer 20 may be formed across the entire surface of the sintered R-T-B based magnet 100.

Figure 1C:
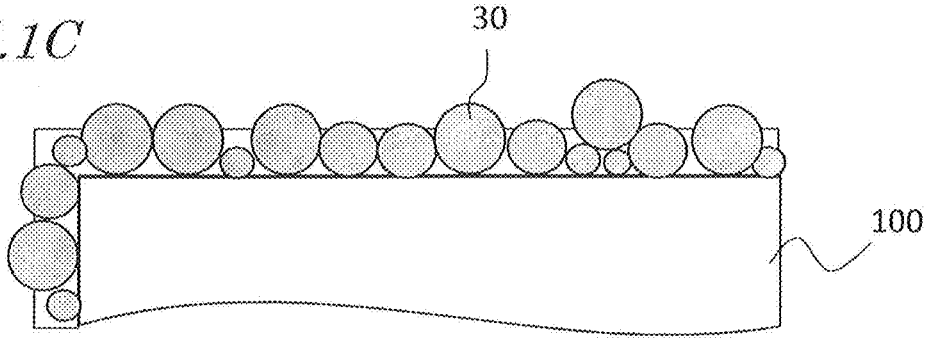
FIG. 1C A cross-sectional view schematically showing a part of a sintered R-T-B based magnet 100 having a particle size-adjusted powder adhering thereto.

FIG. 1C is a cross-sectional view schematically showing a part of the sintered R-T-B based magnet 100 having a particle size-adjusted powder adhering thereto. The powder particles 30 composing the particle size-adjusted powder that are located on the surface of the sintered R-T-B based magnet 100 are allowed to adhere in a manner of covering the application area, thus constituting a layer of particle size-adjusted powder. The method for producing a sintered R-T-B based magnet according to the present disclosure allows the particle size-adjusted powder to easily adhere through a single application step, without even changing the orientation of the sintered R-T-B based magnet 100, in a plurality of regions of the surface of the sintered R-T-B based magnet 100 that have differing normal directions (e.g., an upper face 100*a* and a side face 100*b*). It is also easy for the particle size-adjusted powder to uniformly adhere to the entire surface of the sintered R-T-B based magnet 100.

In the example shown in FIG. 1C, the particle size-adjusted powder adhering to the surface of the sintered R-T-B based magnet 100 has a layer thickness which is approximately the particle size of powder particles composing the particle size-adjusted powder. When the sintered R-T-B based magnet 100 having the particle size-adjusted powder adhering thereto as such is subjected to a diffusion heat treatment, the heavy rare-earth element RH contained in the particle size-adjusted powder can be diffused from the surface into the interior of the sintered R-T-B based magnet, efficiently without waste.

According to an embodiment of the present disclosure, the particle size-adjusted powder (diffusion source powder) which has adhered to the application area in the adhesion step is composed of: (1) a plurality of particles being in contact with the surface of the adhesive layer 20; (2) a plurality of particles adhering to the surface of the sintered R-T-B based magnet 100 via nothing but the adhesive layer 20; and (3) other particles sticking to one or more particles among the plurality of particles not via any adhesive material. Note that not all of (1) to (3) above are required; rather, the particle size-adjusted powder adhering to the application area may be composed of (1) and (2) alone, or (2) alone.

The region that is composed of the aforementioned (1) to (3) of the particle size-adjusted powder does not need to account for the entire application area; rather, 80% or more of the entire application area may be composed of (1) to (3) above. In order to allow the particle size-adjusted powder sintered R-T-B based magnet to adhere more uniformly, the application area in which the particle size-adjusted powder is composed of (1) to (3) above preferably accounts for 90% or more of the entire application area, and, most preferably, the entire application area is composed of (1) to (3) above.

Figure 1D:
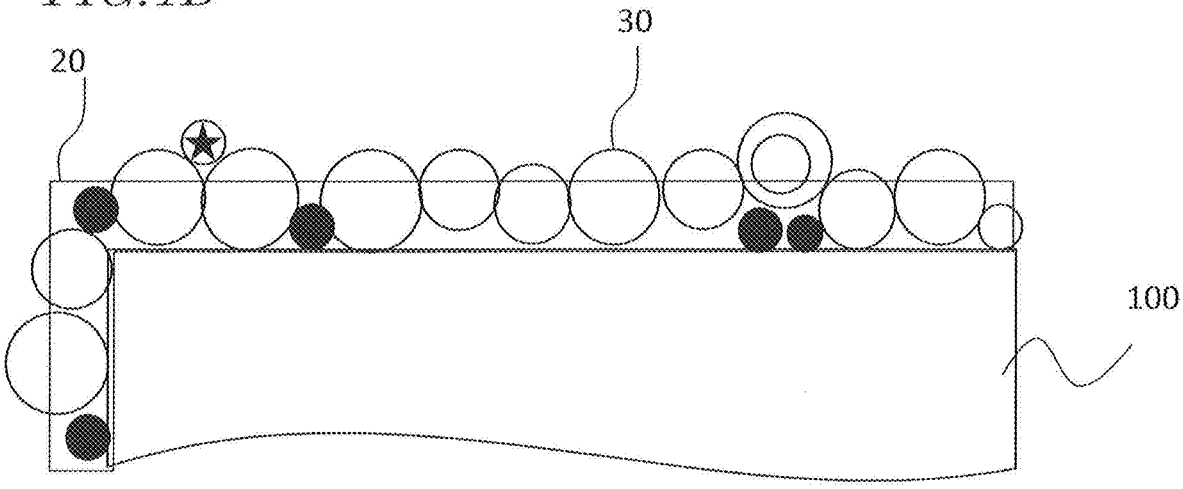
FIG. 1D A schematic diagram exemplifying how a particle size-adjusted powder may adhere according to the present disclosure.

FIG. 1D is an explanatory diagram exemplifying the constitutions of (1) to (3) above according to the present invention. In FIG. 1D, (1) the powder particles being in contact with the surface of the adhesive layer 20 are depicted as "double circle" powder particles (corresponding to the constitution of (1) alone); (2) the powder particles adhering to the surface of the sintered R-T-B based magnet 100 via nothing but the adhesive layer 20 are depicted as "dark circle" powder particles; (3) other particles sticking to one or more particles among the plurality of particles not via any adhesive material are depicted as "starred circle" powder particles; and powder particles corresponding to both (1) and (2) are depicted as "blank circle" powder particles. Note that (1) is satisfied if some of the powder particles 30 are in contact with the surface of the adhesive layer 20; (2) is satisfied if no other powder particles or the like, besides the adhesive agent, are present between the powder particles 30 and the surface of the sintered R-T-B based magnet; and (3) is satisfied if the adhesive layer 20 is not in contact with the powder particles 30. As shown in FIG. 1D, by ensuring that the particle size-adjusted powder that was allowed to adhere to the application area in the adhesion step are composed of (1) to (3), approximately one layer is allowed to adhere to the surface of the sintered R-T-B based magnet.

Figure 1E:
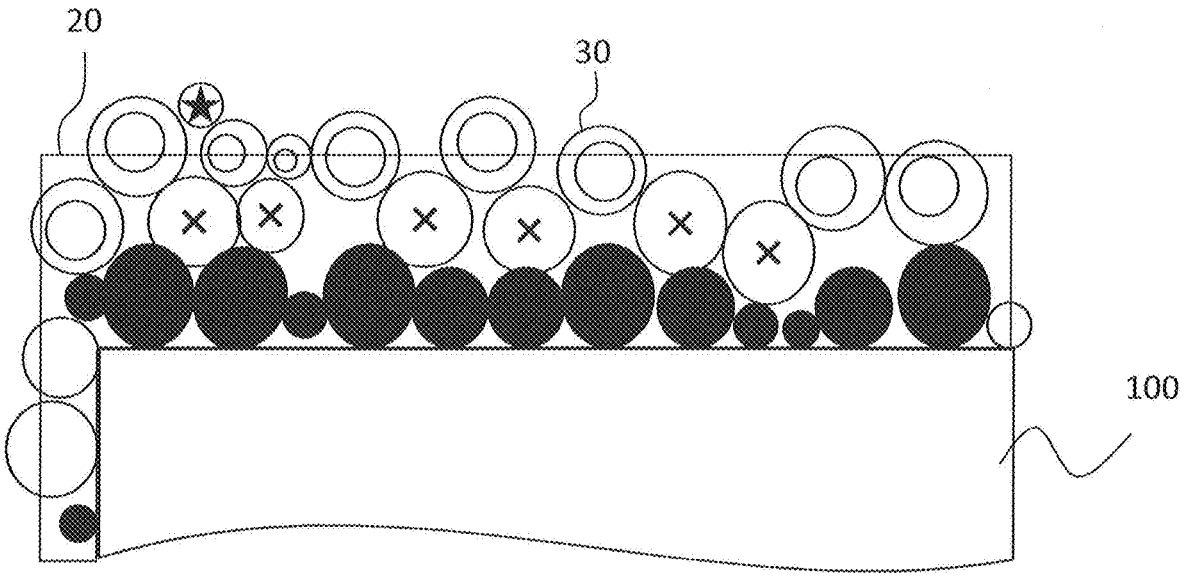
FIG. 1E A schematic diagram exemplifying how a particle size-adjusted powder may adhere according to Comparative Example.

On the other hand, FIG. 1E is an explanatory diagram exemplifying, as Comparative Example, a case where constitutions other than (1) to (3) above are included. Powder particles not corresponding to any of (1) to (3) are depicted as "x" powder particles. As shown in FIG. 1E, due to inclusion of constitutions other than (1) to (3), the particle size-adjusted powder is formed in a number of layers on the surface of the sintered R-T-B based magnet.

As mentioned earlier, Patent Documents 1 to 4 describe an immersion/lifting technique or a spray coating technique as methods for allowing a powder mixture containing a powder of RH compound to be present on the entire magnet surface (the entire surface of the magnet). In the immersion/lifting technique, the lower portion of the magnet becomes thicker due to gravity; and in spraying, the edge of the magnet becomes thicker due to surface tension. As a result, in the thickened portion and its neighborhood, the powder particles 30 will be formed in a number of layers of as illustrated in FIG. 1E. According to an embodiment of the present disclosure, with good reproducibility, the same amount of powder is allowed to adhere to the magnet surface. That is, once the particle size-adjusted powder has adhered to the magnet surface in the states illustrated in FIG. 1C and FIG. 1D, the particles composing the particle size-adjusted powder hardly adhere to the application area, even if the particle size-adjusted powder keeps being supplied to the application area of the magnet surface. Therefore, it is easy to control the adhered amount of the particle size-adjusted powder, and hence the diffused amount(s) of the element(s).

According to an embodiment of the present disclosure, the thickness of the adhesive layer 20 is not less than 10 μm and not more than 100 μm.

One important aspect of the method for producing a sintered R-T-B based magnet according to the present disclosure is in controlling the particle size of the particle size-adjusted powder in order to control a mass ratio of the heavy rare-earth element RH to be diffused into the sintered R-T-B based magnet to the sintered R-T-B based magnet (which hereinafter will be simply referred to as "RH amount"). This particle size is set so that, when powder particles composing the particle size-adjusted powder are placed on the entire surface of the sintered R-T-B based magnet to form a single particle layer (or it is so contemplated), the amount of heavy rare-earth element RH contained in the particle size-adjusted powder on the magnet surface is in a range from 0.6 to 1.5% by mass ratio with respect to the sintered R-T-B based magnet. For a higher $H_{cJ}$, preferably the particle size may be set so as to be in a range from 0.7 to 1.5%. In other words, the particle size of the particle size-adjusted powder is set so that the powder particles composing the particle size-adjusted powder will form a single particle layer on the entire surface of the sintered R-T-B based magnet, and that the amount of heavy rare-earth element RH that is contained in the particle layer is in a range from 0.6 to 1.5% (preferably 0.7 to 1.5%) by mass ratio with respect to the sintered R-T-B based magnet. As used herein, "a single particle layer" is based on the assumption that one layer is allowed to adhere to the surface of the sintered R-T-B based magnet while leaving no spaces (i.e., adhering in a close-packed manner), where any minute spaces that may be present between powder particles and between each powder particle and the magnet surface are ignored.

Figure 2:
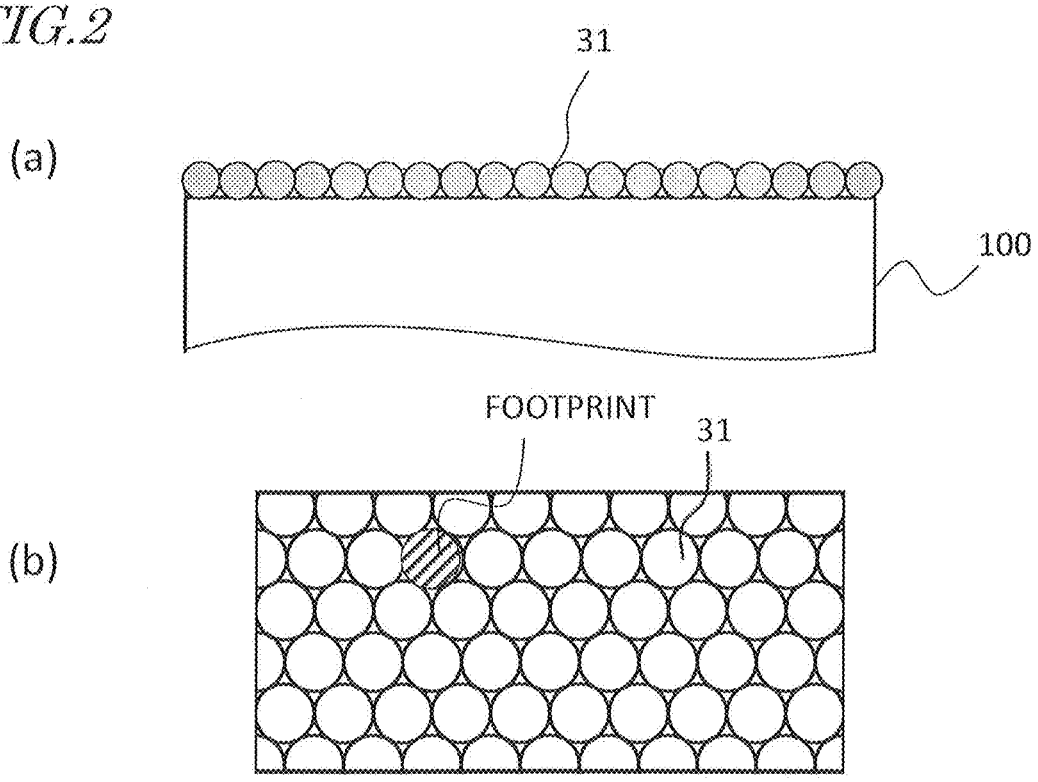
FIG. 2 (a) is a cross-sectional view schematically showing a part of the sintered R-T-B based magnet 100 having a particle size-adjusted powder adhering thereto; and (b) is a diagram showing a partial surface of the sintered R-T-B based magnet 100 having a particle size-adjusted powder adhering thereto, as viewed from above.
Figure 3:
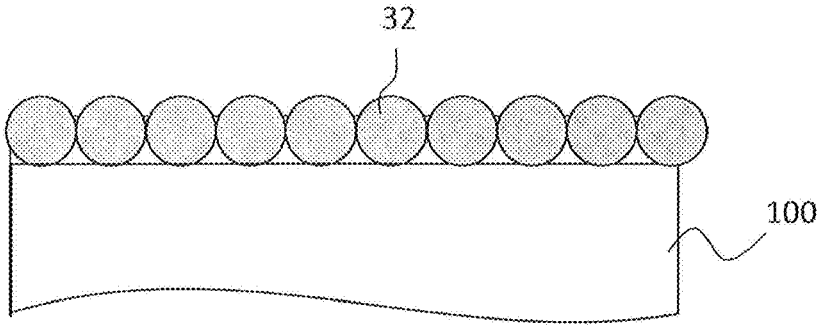
FIG. 3 (a) is a cross-sectional view schematically showing a part of the sintered R-T-B based magnet 100 having a particle size-adjusted powder adhering thereto; and (b) is also a diagram showing a partial surface of the sintered R-T-B based magnet 100 having a particle size-adjusted powder adhering thereto, as viewed from above.
Figure 3:
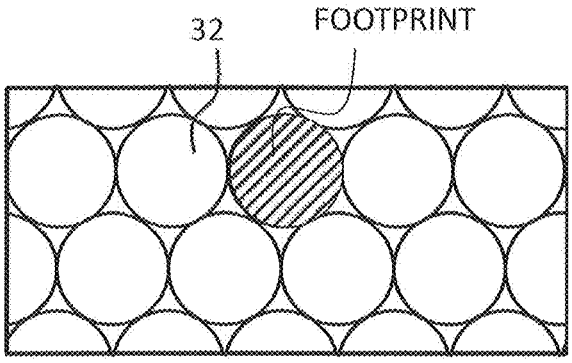

With reference to FIG. 2 and FIG. 3, it will be explained how the RH amount can be controlled through a particle size control of the particle size-adjusted powder. FIG. 2(*a*) and FIG. 3(*a*) are both cross-sectional views schematically showing a part of the sintered R-T-B based magnet 100 having the particle size-adjusted powder adhering thereto. Also, FIG. 2(*b*) and FIG. 3(*b*) are both diagrams showing a partial surface of the sintered R-T-B based magnet 100 having the particle size-adjusted powder adhering thereto as viewed from above. The illustrated particle size-adjusted powder is composed of powder particles 31 with a relatively smaller particle size, or powder particles 32 with a relatively large particle size.

For simplicity, it is assumed that the particle size of each powder adhering to the magnet surface is uniform. It is also assumed that the amount of heavy rare-earth element RH (RH concentration) per unit volume of the powder particles 31 and that of the powder particles 32 are equal. It is assumed that the powder particles 31 and the powder particles 32 are allowed to adhere in one layer to the surface of the sintered R-T-B based magnet while leaving no spaces (i.e., adhering in a close-packed manner), where any minute spaces that may be present between powder particles and between each powder particle and the magnet surface are ignored.

It is assumed that the powder particles 32 in FIG. 3 have a particle size which is exactly twice as large as the particle size of the powder particles 31 in FIG. 2. Accordingly, if one powder particle 31 has a footprint S on the surface of the sintered R-T-B based magnet, then one powder particle 32 will have a footprint of $2^2S=4S$ on the surface of the sintered R-T-B based magnet. Moreover, if the amount of heavy rare-earth element RH contained in the powder particles 31 is x, then the amount of heavy rare-earth element RH contained in the powder particles 32 is $2^3x=8x$. The number of powder particles 31 per unit area of the surface of the sintered R-T-B based magnet is 1/S, and the number of powder particles 32 per unit area is ¼S. Therefore, the amount of heavy rare-earth element RH per unit area of the surface of the sintered R-T-B based magnet is $x\times1/S=x/S$ for the powder particles 31, and $8x\times\frac{1}{4}S=2x/S$ for the powder particles 32. By allowing the powder particles 32 to adhere to the magnet surface in just one layer while leaving no spaces, the amount of heavy rare-earth element RH that is present on the surface of the sintered R-T-B based magnet is doubled as compared to that of the powder particles 31.

In the above example, by increasing the particle size twofold, the amount of heavy rare-earth element RH that is present on the surface of the sintered R-T-B based magnet can be increased twofold. As can be seen from this simplified example, by controlling the particle size of the particle size-adjusted powder, it is possible to control the amount of heavy rare-earth element RH that is present on the surface of the sintered R-T-B based magnet.

The shape of the particles of an actual particle size-adjusted powder will not be completely spherical, and their particle size will also be varied. However, the fact still remains that the amount of heavy rare-earth element RH that is present on the surface of the sintered R-T-B based magnet can be controlled by adjusting the particle size of the particle size-adjusted powder. As a result, through the diffusion heat treatment step, the amount of heavy rare-earth element RH to diffuse from the magnet surface to the magnet interior can be controlled to be within a desired range that is required for improved magnet characteristics, with a good yield.

The particle size (particle size specification) for ensuring that the amount of heavy rare-earth element RH contained in the particle size-adjusted powder on the magnet surface is in a range from 0.6 to 1.5% by mass ratio with respect to the sintered R-T-B based magnet, when the powder particles composing the particle size-adjusted powder is placed on the entire surface of the sintered R-T-B based magnet to form a single particle layer, can be determined through experimentation and/or calculation. In order to determine this through experimentation, a relationship between the particle size of the particle size-adjusted powder and the RH amount may be determined through experimentation, and from there, a particle size of the particle size-adjusted powder (e.g. a range from 100 μm to 500 μm) that will result in the desired RH amount may be determined. Moreover, as mentioned above, the particle size-adjusted powder adhering to the surface of the sintered R-T-B based magnet 100 has a layer thickness which is approximately the particle size of powder particles composing the particle size-adjusted powder. In accordance with the composition of the particle size-adjusted powder, the ratio of an amount of heavy rare-earth element RH that is present on the magnet surface in the case where the particle size-adjusted powder is allowed to adhere in one layer, to that in the case of forming a layer with a thickness which is approximately equal to the particle size, can be determined through experimentation. Based on such experimental results, a particle size of the particle size-adjusted powder that will result in the desired RH amount may then be determined through calculation. Thus, a particle size of the particle size-adjusted powder can be determined through a calculation that is based on data which is obtained through experimentation. Moreover, under simplified conditions as have been described with respect to the above examples of FIG. 2 and FIG. 3, a particle size may be determined through calculation alone, whereby the amount of heavy rare-earth element RH contained in the particle size-adjusted powder on the magnet surface can be set to a desired range.

Note that the amount of heavy rare-earth element RH contained in the particle size-adjusted powder depends not only on the particle size of the particle size-adjusted powder, but also on the RH concentration in the particle size-adjusted powder. Therefore, it is possible to adjust the amount of heavy rare-earth element RH contained in the particle size-adjusted powder by varying the RH concentration in the particle size-adjusted powder, while keeping the particle size constant. However, depending on the compositions or the mixing ratio of a diffusion agent and a diffusion auxiliary agent which will be described in detail later, there are bounds to the composition of the powder particles composing the particle size-adjusted powder itself for efficiently attaining a coercivity improvement. Therefore, in the method according to the present disclosure, the amount of heavy rare-earth element RH contained in the particle size-adjusted powder is controlled by adjusting the particle size. Moreover, the amount of heavy rare-earth element RH which is expected to be present on the magnet surface may vary depending on the size of the sintered R-T-B based magnet; with the method according to the present disclosure, however, the amount of heavy rare-earth element RH can still be controlled by adjusting the particle size of the particle size-adjusted powder.

With the particle size-adjusted powder whose particle size is thus adjusted, as will be described later, a coercivity improvement can be most efficiently attained. Moreover, coercivity improvements can be made with good reproducibility through particle size management.

In preferable embodiments, the aforementioned particle size-adjusted powder is allowed to adhere to the entire surface (the entire surface of the magnet) of the sintered R-T-B based magnet having the adhesive agent applied thereto, such that the amount of heavy rare-earth element RH contained in the particle size-adjusted powder is 0.6 to 1.5 mass %, and preferably in a range from 0.7 to 1.5%, by mass ratio with respect to the sintered R-T-B based magnet.

In preferable embodiments, the particle size-adjusted powder contains a powder of an RHM1M2 alloy (where M1 and M2 are one or more selected from among Cu, Fe, Ga, Co, Ni and Al, possibly M1=M2), or a powder of an RH compound (where RH is one or more selected from among Dy and Tb; and the RH compound is one or more selected from among an RH fluoride, an RH oxyfluoride, and an RH oxide). Moreover, the particle size-adjusted powder when containing an RH compound may further contain a powder of an RLM1M2 alloy (where RL is one or more selected from among Nd and Pr; and M1 and M2 are one or more selected from among Cu, Fe, Ga, Co, Ni and Al, possibly M1=M2).

Hereinafter, details of the present embodiment will be described.

1. Providing a Sintered R-T-B Based Magnet Raw Piece

A sintered R-T-B based magnet raw piece, in which to diffuse a heavy rare-earth element RH, is provided. In the present specification, for ease of understanding, a sintered R-T-B based magnet in which to diffuse a heavy rare-earth element RH may be strictly differentiated as a sintered R-T-B based magnet raw piece; it is to be understood that the term "sintered R-T-B based magnet" is inclusive of any such "sintered R-T-B based magnet raw piece". Those which are known can be used as this sintered R-T-B based magnet raw piece, having the following composition, for example.

rare-earth element R: 12 to 17 at %

B ((boron), part of which may be replaced with C (carbon)): 5 to 8 at % additive element(s) M' (at least one selected from the group consisting of Al, Ti, V, Cr, Mn, Ni, Cu, Zn, Ga, Zr, Nb, Mo, Ag, In, Sn, Hf, Ta, W, Pb and Bi): 0 to 2 at %

T (transition metal element, which is mainly Fe and may include Co) and inevitable impurities: balance Herein, the rare-earth element R consists essentially of a light rare-earth element RL (which is at least one element selected from among Nd and Pr), but may contain a heavy rare-earth element RH. In the case where a heavy rare-earth element is to be contained, preferably at least one of Dy and Tb is contained.

A sintered R-T-B based magnet raw piece of the above composition is produced by any arbitrary production method. The sintered R-T-B based magnet raw piece may have just been sintered, or have been subjected to cutting or polishing.

2. Providing a Particle Size-Adjusted Powder

[Diffusion Agent]

The particle size-adjusted powder is composed of a powder of an alloy or a compound of a heavy rare-earth element RH which is at least one of Dy and Tb. Powders of any such alloy and compound all function as diffusion agents.

An alloy of a heavy rare-earth element RH may be for example, an RHM1M2 alloy (where M1 and M2 are one or more selected from among Cu, Fe, Ga, Co, Ni and Al, possibly M1=M2).

The method of producing the RHM1M2 alloy powder is not particularly limited. It may be provided by a method which makes a thin strip of alloy by a roll quenching technique, and then pulverizes this thin strip of alloy; or it may be produced by a known atomization technique, such as centrifugal atomization, a rotating electrode method, gas atomization, or plasma atomization. An ingot which has been produced by a casting technique may be pulverized. In the case where it is produced by a quenching technique or a casting technique, it is ensured that M1≠M2 for better pulverizability. Typical examples of RHM1M2 alloys are DyFe alloys, DyAl alloys, DyCu alloys, TbFe alloys, TbAl alloys, TbCu alloys, DyFeCu alloys, TbCuAl alloy, and the like. The particle size of an RHM1M2 alloy powder may be e.g. 500 μm or less, with the smaller ones being on the order of 10 μm.

A compound of a heavy rare-earth element RH may be one or more selected from among an RH fluoride, an RH oxyfluoride, and an RH oxide, which may be collectively referred to as RH compounds. The RH oxyfluoride may be what is included in an RH fluoride as an intermediate substance during the production steps of the RH fluoride. A powder of any such compound may be used alone by itself, or mixed with an RLM1M2 alloy powder which will be described later. Many RH compounds in powder form that are available have a particle size of 20 μm or less, or typically 10 μm or less, in terms of the size of an aggregated secondary particle; on the other hand, the smaller ones are on the order of several μm as primary particles.

[Diffusion Auxiliary Agent]

The particle size-adjusted powder may contain a powder of alloy that functions as a diffusion auxiliary agent. An example of such an alloy is an RLM1M2 alloy. RL is one or more selected from among Nd and Pr; M1 and M2 are one or more selected from among Cu, Fe, Ga, Co, Ni and Al, possibly M1=M2. Typical examples of RLM1M2 alloys are NdCu alloys, NdFe alloys, NdCuAl alloys, NdCuCo alloys, NdCoGa alloys, NdPrCu alloys, NdPrFe alloys, and the like. Such alloys in powder form are used in a mixture with the aforementioned RH compound powder. A plurality of kinds of RLM1M2 alloy powders and RH compound powders may be used in mixture. The method of producing the powder of RLM1M2 alloy is not particularly limited. When it is produced by a quenching technique or a casting technique, it is ensured that M1≠M2 for better pulverizability, and an alloy of a ternary system or above, e.g., an NdCuAl alloy, an NdCuCo alloy, or an NdCoGa alloy, is preferably adopted. The particle size of the RLM1M2 alloy powder may be e.g. 500 μm or less, with the smaller ones being on the order of 10 μm. Although the RL is one or more selected from among Nd and Pr, as other elements, at least one rare-earth element other than Dy and Tb may be contained in a small amount such that the effects of the present invention are not undermined.

[RHRLM1M2 Alloy]

The particle size-adjusted powder may be provided by separately producing a diffusion agent and a diffusion auxiliary agent, or may be provided by producing an alloy that contains elements of both of a diffusion agent and a diffusion auxiliary agent. A diffusion agent including a diffusion auxiliary agent may be an RHRLM1M2 alloy (where RH is at least one of Dy and Tb; RL is one or more selected from among Nd and Pr; and M1 and M2 are one or more selected from among Cu, Fe, Ga, Co, Ni and Al, possibly M1=M2), for example. Typical examples are TbNdCu alloys, DyNdCu alloys, TbNdFe alloys, DyNdFe alloys, TbNdCuAl alloys, DyNdCuAl alloys, TbNdCuCo alloys, DyNdCuCo alloys, TbNdCoGa alloys, DyNdCoGa alloys, TbNdPrCu alloys, DyNdPrCu alloys, TbNdPrFe alloys, DyNdPrFe alloys, and the like. Although the RL is one or more selected from among Nd and Pr, as other elements, at least one rare-earth element other than Dy and Tb may be contained in a small amount such that the effects of the present invention are not undermined.

[Particle Size Adjustment]

These powders will each have their particle size adjusted, in a mixture or alone by itself, whereby a particle size-adjusted powder is produced. The particle size is set so that, when the powder particles composing the particle size-adjusted powder is placed on the entire surface of the sintered R-T-B based magnet to form a single particle layer, the amount of heavy rare-earth element RH contained in the particle size-adjusted powder is in a range from 0.6 to 1.5% (preferably 0.7 to 1.5%) by mass ratio with respect to the sintered R-T-B based magnet. The particle size may be, as described above, determined through experimentation and/or calculation. Preferably, the experimentation for particle size determination is performed in accordance with the actual production method.

As the mass ratio of the heavy rare-earth element RH to be diffused into the sintered R-T-B based magnet to the sintered R-T-B based magnet increases from zero, greater coercivity increments are obtained. However, through a separately performed experiment, it was found that, when conditions other than the RH amount are the same, e.g., the heat treatment condition, coercivity is saturated near an RH amount of 1.0 mass %; the coercivity increment will not become greater even if the RH amount is increased from 1.5 mass %. In other words, when an amount of RH that accounts for 0.6 to 1.5 mass %, and preferably 0.7 to 1.5 mass %, of the sintered R-T-B based magnet is allowed to adhere to the surface of the sintered R-T-B based magnet, a coercivity improvement can be most efficiently attained.

Prescribing the RH amount so as to fall in the aforementioned range when adhering in approximately one layer to the surface of the sintered R-T-B based magnet provides an advantage of being able to manage the RH amount or coercivity improvement through particle size adjustments. Although depending on the RH amount contained in the particle size-adjusted powder, the optimum particle size is e.g. greater than 100 μm and equal to or less than 500 μm.

Preferably, the particle size-adjusted powder is allowed to adhere to the entire surface of the sintered R-T-B based magnet having the adhesive agent applied thereto. The reason is that a more efficient coercivity improvement can be attained.

The particle size of the particle size-adjusted powder may be adjusted through screening. If the particle size-adjusted powder to be eliminated through screening accounts for 10 mass % or less, it will not matter very much; thus, screening may be omitted. In other words, preferably 90 mass % or more of the particle size of the particle size-adjusted powder falls within the aforementioned range.

In a mixture or alone by itself, these powders are preferably granulated with a binder. By being granulated with a binder, the binder will melt through a post-heating step to be described below, such that powder particles will become united by the melted binder, thus becoming less likely to drop and providing an advantage of easier handling. In the case where a plurality of kinds of powders are used in mixture, granulation with a binder allows a particle size-adjusted powder with a uniform mixing ratio to be produced, thereby making it easier for these powders to be each present on the surface of the sintered R-T-B based magnet with a certain mixing ratio.

When an RHM1M2 alloy powder is used by itself, particle size adjustments are possible without granulation. For example, if the shape of the powder particles is isometric or spherical, then the particle size may be adjusted so that the RH amount in the RHM1M2 alloy powder to adhere is 0.6 to 1.5% by mass ratio with respect to the sintered R-T-B based magnet, whereby it can be straightforwardly used without granulation.

When an RHRLM1M2 alloy powder is, too, particle size adjustments are possible without granulation. For example, if the shape of the powder particles is isometric or spherical, then the particle size may be adjusted so that the RH amount in the RLRHM1M2 alloy powder to adhere is 0.6 to 1.5% by mass ratio with respect to the sintered R-T-B based magnet, whereby it can be straightforwardly used without granulation.

As the binder, those which will not adhere or aggregate when dried or when the mixed solvent is removed, such that the particle size-adjusted powder can retain smooth fluidity, are preferable. Examples of binders include PVA (polyvinyl alcohol) and the like. As necessary, an aqueous solvent such as water, or an organic solvent such as NMP (n-methylpyrrolidone) may be used for mixing. The solvent will be removed through evaporation in the granulation process to be described later.

When a powder of RLM1M2 alloy and a powder of RH compound are used in mixture, these powders alone being mixed may not easily result in uniform mixing. The reason for this is that, generally speaking, a powder of RH compound has a relatively small particle size as compared to that of a powder of RLM1M2 alloy. For example, a powder of RLM1M2 alloy typically has a particle size of 500 μm or less, whereas a powder of RH compound typically has a particle size of 20 μm or less. Therefore, a particle size-adjusted powder which is obtained through granulation of a powder of RLM1M2 alloy, a powder of RH compound, and a binder is preferably used. Adopting such a particle size-adjusted powder provides an advantage in that a uniform mixing ratio between the powder of RLM1M2 alloy and the powder of RH compound can be obtained throughout the entire powder. Uniform presence on the magnet surface is also made possible.

The method of granulation with a binder may be arbitrary, e.g., a tumbling granulation method, a fluid bed granulate method, a vibration granulation method, a dry impact blending method (hybridization), a method which mixes a powder and a binder and disintegrates it after solidification, and so on.

When a powder of RLM1M2 alloy and a powder of RH compound are mixed, the abundance ratio between the RLM1M2 alloy and the RH compound in powder state, on the surface of the sintered R-T-B based magnet (before heat treatment), may be RLM1M2 alloy:RH compound=96:4 to 50:50 by mass ratio. In other words, within the entire powder mixture that is contained in the paste, the powder of RLM1M2 alloy may account for not less than 50 mass % and not more than 96 mass %. The abundance ratio may be RLM1M2 alloy:RH compound=95:5 to 60:40. In other words, the powder of RLM1M2 alloy may account for not less than 60 mass % and not more than 95 mass % of the entire powder mixture. When the RLM1M2 alloy and the RH compound are used by being mixed at this mass ratio, the RLM1M2 alloy will efficiently reduce the RH compound. As a result, sufficiently-reduced RH will diffuse into the sintered R-T-B based magnet, whereby $H_{cJ}$ can be greatly improved with a small RH amount. When the RH compound contains a fluoride or an oxyfluoride of RH, the RLM1M2 alloy will efficiently reduce the RH compound, so that the fluorine contained in the RH compound will not intrude into the interior of the sintered R-T-B based magnet, but will be left outside the sintered R-T-B based magnet by binding with the RL in the RLM1M2 alloy, as has been confirmed through a separate experiment by the inventors. That fact that fluorine does not intrude into the interior of the sintered R-T-B based magnet is believed to be a factor which prevents significant lowering of $B_r$ in the sintered R-T-B based magnet.

In an embodiment of the present disclosure, presence of a powder (third powder) other than the powders of RLM1M2 alloy and RH compound on the surface of the sintered R-T-B based magnet is not necessarily precluded; however, care must be taken so that the third powder will not hinder the RH in the RH compound from diffusing into the sintered R-T-B based magnet. It is desirable that the powders of "RLM1M2 alloy and RH compound" account for 70% or more by mass ratio in the entire powder that exists on the surface of the sintered R-T-B based magnet.

By using powders whose particle size is thus adjusted, powder particles composing the particle size-adjusted powder are allowed to uniformly adhere to the entire surface of the sintered R-T-B based magnet, efficiently without waste. In the method according to the present disclosure, imbalances in the thickness of a coating film, as may occur due to gravity or surface tension in the immersion or spraying under conventional techniques, will not occur.

In order to allow powder particles composing the particle size-adjusted powder to be present more uniformly on the surface of the sintered R-T-B based magnet, preferably the powder particles are placed in approximately one layer, or specifically, in not less than one layer and not more than three layers, on the surface of the sintered R-T-B based magnet. When a plurality of kinds of powders are granulated for use, particles of the granulated particle size-adjusted powder are allowed to be present in not less than one layer and not more than three layers. As used herein, "not more than three layers" means that, depending on the thickness of the adhesive agent or the size of each particle, particles may be allowed to adhere up to three layers in parts, rather than these particles adhering continuously in three layers. In order to more accurately manage the adhered amount of RH on the basis of particle size, the thickness of the coating layer is preferably not less than one layer, but less than two layers, of powder particles (i.e., the layer thickness is equal to or greater than the particle size (lowest particle size) but less than twice the particle size (lowest particle size)), i.e., the particle size-adjusted powder will not be mutually bonded by the binder in the particle size-adjusted powder so as to be stacked in two or more layers.

3. Adhesive Agent Application Step

Examples of adhesive agents include PVA (polyvinyl alcohol), PVB (polyvinyl butyral), PVP (polyvinyl pyrrolidone), and the like. In the case where the adhesive agent is an aqueous adhesive agent, the sintered R-T-B based magnet may be subjected to preliminary heating before the application. The purpose of preliminary heating is to remove excess solvent and control adhesiveness, and to allow the adhesive agent to adhere uniformly. The heating temperature is preferably 60° C. to 100° C. In the case of an organic solvent-type adhesive agent that is highly volatile, this step may be omitted.

The method of applying an adhesive agent onto the surface of the sintered R-T-B based magnet may be arbitrary. Specific examples of application include spraying, immersion, application by using a dispenser, and so on.

4. Step of Allowing Particle Size-Adjusted Powder to Adhere to the Surface of the Sintered R-T-B Based Magnet In one preferable implementation, an adhesive agent is applied to the entire surface of the sintered R-T-B based magnet (entire surface). Rather than to the entire surface of the sintered R-T-B based magnet, it may be allowed to adhere to a portion thereof.

Especially when the sintered R-T-B based magnet has a thin thickness (e.g., about 2 mm), among surfaces of the sintered R-T-B based magnet, only the one surface that is the largest in geometric area may have the particle size-adjusted powder adhering thereto, whereby a heavy rare-earth element RH can be diffused into the entire magnet and improve $H_{cJ}$ in some cases. With the production method according to the present disclosure, through a single step, the particle size-adjusted powder can be allowed to adhere in not less than one layer and not more than three layers to a plurality of regions of different normal directions within the surface of the sintered R-T-B based magnet.

Since it is intended in the present invention that the particle size-adjusted powder adhere in approximately one layer, the thickness of the adhesive layer is preferably on the order of the lowest particle size of particle size-adjusted powder. Specifically, the thickness of the adhesive layer is preferably not less than 10 μm and not more than 100 μm.

The method of allowing the particle size-adjusted powder to adhere to the sintered R-T-B based magnet may be arbitrary. Examples of the methods of adhesion include: a method which allows the particle size-adjusted powder to adhere to the sintered R-T-B based magnet having the adhesive agent applied thereto by using a fluidized-bed coating method which will be described later; a method in which the sintered R-T-B based magnet having the adhesive agent applied thereto is dipped in a process chamber accommodating the particle size-adjusted powder; a method in which the particle size-adjusted powder is sprinkled over the sintered R-T-B based magnet having the adhesive agent applied thereto; and so on. At this time, the process chamber accommodating the particle size-adjusted powder may be subjected to vibration, or the particle size-adjusted powder may be allowed to flow, in order to facilitate adhesion of the particle size-adjusted powder to the surface of the sintered R-T-B based magnet. However, since the particle size-adjusted powder is intended to adhere in approximately one layer according to the present invention, it is preferable that adhesion is based substantially solely on the adhesiveness of the adhesive agent. For example, a method where a powder for adhesion is placed in a process chamber together with an impact medium and allowed to adhere to the surface of the sintered R-T-B based magnet by virtue of an impact, or further where the powder is mutually allowed to bind with an impact force from the impact medium for film growth, is not preferable because not only approximately one layer but also a number of layers will be formed.

As the method of adhesion, for example, a method in which a sintered R-T-B based magnet having the adhesive agent applied thereto is immersed in a flowing particle size-adjusted powder, i.e., a so-called fluidized-bed coating method (fluidized bed coating process), may be used. Hereinafter, an example of applying a fluidized-bed coating method will be described. A fluidized-bed coating method is a method which has conventionally been broadly conducted in fields of powder coating; a heated object to be coated is immersed in a flowing thermoplastic powder coating, so that the coating is allowed to melt and adhere with the heat on the surface of the object to be coated. In this example, in order to apply the fluidized-bed coating method to a magnet, the aforementioned particle size-adjusted powder is used instead of a thermoplastic powder coating, and the sintered R-T-B based magnet having the adhesive agent applied thereto is used instead of a heated coating object.

The method for causing the particle size-adjusted powder to flow may be arbitrary. For instance, as one specific example, a method where a chamber having a porous partition in its lower portion will be described. In this example, the particle size-adjusted powder is placed in the chamber, and a gas such as atmospheric air or an inert gas is pressured so as to be injected into the chamber from below the partition, and the particle size-adjusted powder above the partition is allowed to be lifted and flow with the pressure or jet.

By allowing the sintered R-T-B based magnet having the adhesive agent applied thereto to be immersed in (or placed on, or passed through) a particle size-adjusted powder which is flowing inside the chamber, the particle size-adjusted powder is allowed to adhere to the sintered R-T-B based magnet. The time for which the sintered R-T-B based magnet having the adhesive agent applied thereto is immersed may be e.g. on the order of 0.5 to 5.0 seconds. By using the fluidized-bed coating method, the particle size-adjusted powder is allowed to flow (i.e., agitated) within the chamber, whereby relatively large powder particles can be restrained from adhering to the magnet surface in abundance, or conversely, relatively small powder particles can be restrained from adhering to the magnet surface at a distance. As a result, the particle size-adjusted powder can adhere to the sintered R-T-B based magnet more uniformly.

In one preferable embodiment, a heat treatment (post heat treatment) is performed for causing the particle size-adjusted powder to become fixed to the surface of the sintered R-T-B based magnet. The heating temperature may be set to 150 to 200° C. If the particle size-adjusted powder is one that has been granulated with a binder, the binder will melt and become fixed, thereby causing the particle size-adjusted powder to become fixed.

5. A Diffusing Step of Subjecting the Sintered R-T-B Based Magnet Having the Particle Size-Adjusted Powder Adhering Thereto to a Heat Treatment The heat treatment temperature for diffusion is equal to or lower than the sintering temperature of the sintered R-T-B based magnet (specifically, 1000° C. or below, for example). In the case where the particle size-adjusted powder contains a powder of RLM1M2 alloy, the temperature is higher than its melting point, e.g., 500° C. or above. The heat treatment time is e.g. 10 minutes to 72 hours. After the above heat treatment, as necessary, a further heat treatment at 400 to 700° C. may be performed for 10 minutes to 72 hours.

EXAMPLES

Experimental Example 1

First, by a known method, a sintered R-T-B based magnet with the following mole fractions was produced: Nd=13.4, B=5.8, Al=0.5, Cu=0.1, Co=1.1, balance=Fe (at %). By machining this, a sintered R-T-B based magnet raw piece which was sized 4.9 mm thick×7.5 mm wide×40 mm long was obtained. Magnetic characteristics of the resultant sintered R-T-B based magnet raw piece were measured with a B-H tracer, which indicated an $H_{cJ}$ of 1035 kA/m and a $B_r$ of 1.45 T.

Next, a $TbF_3$ powder and an NdCu powder were granulated with a binder to produce a particle size-adjusted powder. The $TbF_3$ powder was a commercially available aspherical powder, with a particle size of 10 μm or less. The NdCu powder was a spherical powder of $Nd_{70}Cu_{30}$ alloy produced by a centrifugal atomization technique, having a particle size of 106 μm or less. PVA (polyvinyl alcohol) was used as the binder, and water was used as a solvent. A paste which was mixed so that $TbF_3$ powder:NdCu powder:PVA:water=36:54:5:5 (mass ratio) was subjected to hot air drying in order to evaporate the solvent, and pulverized in an Ar ambient. The pulverized granulate powder was subjected to screening, thus being classified into the following four: particle sizes of 150 μm or less, 150 to 300 μm, greater than 300 μm but 500 μm or less, 300 μm or less (i.e., anything greater than 300 μm was only eliminated, while anything 150 μm or less was not eliminated).

Next, an adhesive agent was applied to the sintered R-T-B based magnet raw piece. After the sintered R-T-B based magnet raw piece was heated to 60° C. on a hot plate, the adhesive agent was applied to the entire surface of the sintered R-T-B based magnet raw piece by spraying. As the adhesive agent, PVP (polyvinyl pyrrolidone) was used.

Next, the particle size-adjusted powder was allowed to adhere to the sintered R-T-B based magnet raw piece having the adhesive agent applied thereto. The particle size-adjusted powder was spread out in a process chamber, and after the sintered R-T-B based magnet raw piece having the adhesive agent applied thereto was cooled to room temperature, the particle size-adjusted powder was allowed to adhere, in a manner of dusting, over the entire surface of the sintered R-T-B based magnet raw piece in the process chamber.

Figure 5A:
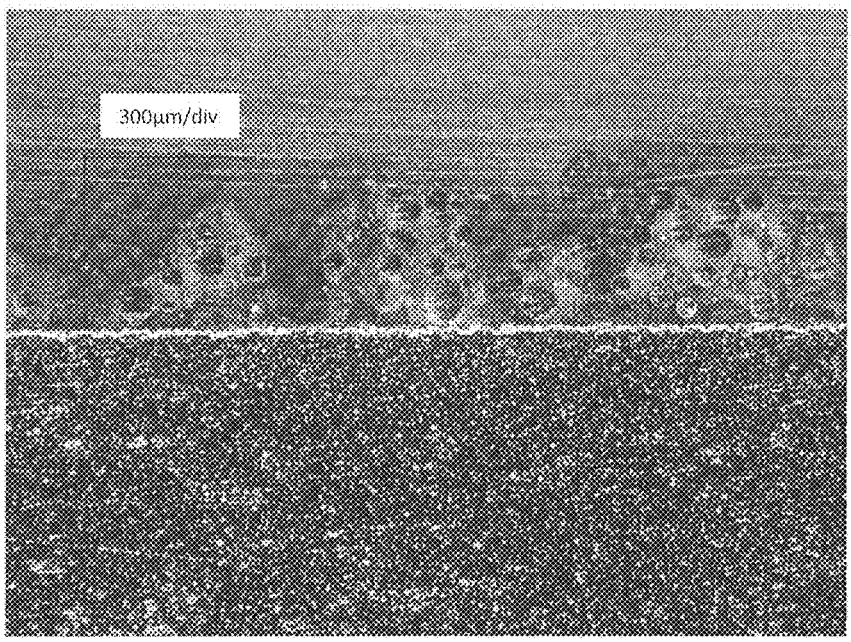
FIG. 5A A diagram showing a partial cross section of a sample having a particle size-adjusted powder with a particle size of 150 to 300 μm adhering thereto.
Figure 5B:
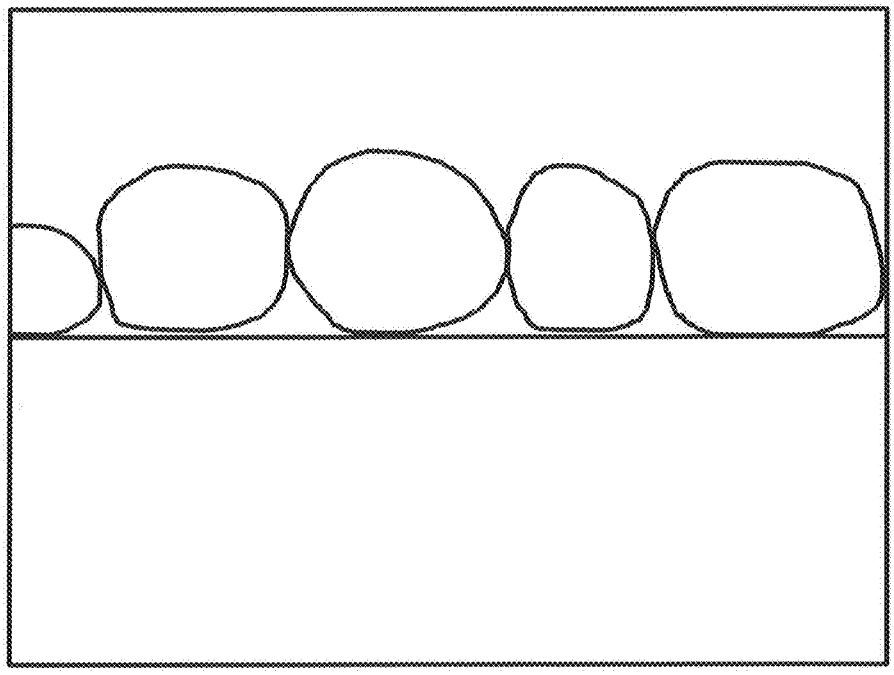
FIG. 5B A diagram schematically showing how particles composing the particle size-adjusted powder shown in FIG. 5A have adhered.

The sintered R-T-B based magnet raw piece having the particle size-adjusted powder adhering thereto was observed with a stereomicroscope, which revealed that the particle size-adjusted powder had adhered uniformly in one layer to the surface of the sintered R-T-B based magnet raw piece, while leaving substantially no spaces. A cross-sectional observation was made with respect to a sample whose particle size-adjusted powder had a particle size of 150 to 300 μm, which resulted in a photograph shown FIG. 5A. Since the cross section of the sample is processed for the sake of observation, the edge (outline) of the particle size-adjusted powder is obscured in the photograph of FIG. 5A. FIG. 5B is a diagram schematically showing how the particles 30 composing the particle size-adjusted powder particles in FIG. 5A have adhered. With reference to FIG. 5B, as can be seen from FIG. 5A, the particles 30 composing the particle size-adjusted powder densely adhere so as to form one layer (particle layer). It was also confirmed that the particle size-adjusted powder having a particle size of 150 to 300 μm satisfied: (1) a plurality of particles being in contact with the surface of the adhesive layer 20; (2) a plurality of particles adhering to the surface of the sintered R-T-B based magnet 100 via nothing but the adhesive layer 20; and (3) other particles sticking to one or more particles among the plurality of particles not via any adhesive material, in accordance with the present disclosure.

Figure 4:
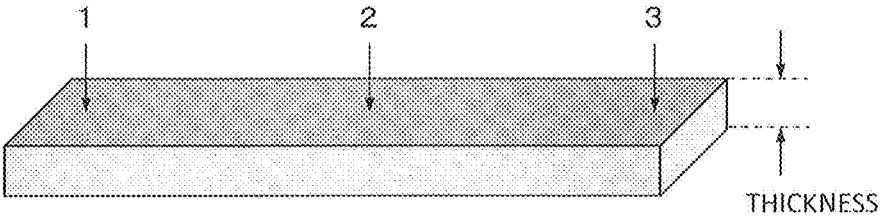
FIG. 4 A perspective view showing positions at which the layer thickness of a particle size-adjusted powder on the sintered R-T-B based magnet 100 was measured.

Moreover, with respect to samples whose particle size-adjusted powder had a particle size of 150 to 300 μm, the thickness of the sintered R-T-B based magnet raw piece having the particle size-adjusted powder adhering thereto, in the 4.9 mm direction, was measured. For each sintered R-T-B based magnet raw piece, measurements were taken at the three places, i.e., positions 1, 2 and 3 shown in FIG. 4 (N=25 each). The values of increase from the sintered R-T-B based magnet raw piece before the particle size-adjusted powder adhered thereto (i.e., values ascribable to increases on both faces) are shown in Table 1. The values were almost identical among the three places, with hardly any variation in thickness depending on the measurement point. Since even the largest value was less than twice the lowest particle size of 150 μm for one face (i.e., ½ of each value in Table 1), it was confirmed that the particle size-adjusted powder had adhered in one or more layers, but less than two layers, to the surface of the sintered R-T-B based magnet raw piece.

TABLE 1

| position of | increase in thickness after adhesion (μm/2 faces) | | |
|---|---|---|---|
| measurement | max | min | average |
| 1 | 585 | 500 | 540 |
| 2 | 585 | 475 | 530 |
| 3 | 575 | 485 | 525 |

Furthermore, what was obtained by subtracting the mass of the sintered R-T-B based magnet raw piece before the particle size-adjusted powder adhered thereto from the mass of the sintered R-T-B based magnet raw piece having the particle size-adjusted powder adhering thereto was defined as a mass of the particle size-adjusted powder; from this value, a Tb amount (mass %) that had adhered, relative to the magnet mass, was calculated.

The calculated values of adhered amounts of Tb are shown in Table 2. From the results of Table 2, the particle size-adjusted powder having a particle size of 150 to 300 μm had its adhered amount of Tb being in the range from 0.6 to 1.5 mass %, thus allowing for most efficient adhesion of Tb. Any particle size-adjusted powder having a particle size of 150 μm or less had too small a particle size to result in an adequate adhered amount of Tb with a mere adhesion of approximately one layer. On the other hand, any particle size-adjusted powder which was 300 to 500 μm had too large an adhered amount, thus wasting Tb. Moreover, any particle size-adjusted powder which was 300 μm or less (i.e., anything equal to or above the upper limit was only eliminated, while no elimination based on a lower limit was made) had slightly less than a sufficient adhered amount of Tb (although there were sintered R-T-B based magnet raw pieces to which an adhesion of 0.6 or more had been made (e.g., max: 0.68), a large number of sintered R-T-B based magnet raw pieces lacking in the adhered amount were included, as indicated by an average of 0.55; thus, setting the particle size at 300 μm is not preferable). It is inferred that, since finer powder of 150 μm or less was contained, the finer powder adhered first, such that it was difficult for any powder exceeding 150 μm to adhere. From the above experiment, it was indicated that, through controlling the particle size of the particle size-adjusted powder, an RH-containing powder can be allowed to adhere to the magnet surface efficiently and uniformly.

TABLE 2

| particle size of particle | adhered amount of Tb (mass %) | | |
|---|---|---|---|
| size-adjusted powder (μm) | max | min | average |
| 150 μm or less | 0.45 | 0.30 | 0.36 |
| 150-300 μm | 1.22 | 0.90 | 1.12 |
| 300-500 μm | 2.07 | 1.79 | 1.92 |
| 300 μm or less | 0.68 | 0.46 | 0.55 |

Experimental Example 2

To each powder having a particle size of 150 to 300 μm used in Experimental Example 1, 10 mass % of a powder which was 150 μm or less, or 10 mass % of a powder which was greater than 300 μm, was mixed; by a method similar to that of Experimental Example 1, the particle size-adjusted powder was allowed to adhere to the surface of the sintered R-T-B based magnet raw piece. An adhered amount of Tb was calculated from the amount of particle size-adjusted powder that had adhered, which indicated that the adhered amount of Tb was in the range from 0.6 to 1.5 mass % for both cases. This indicates that mixing 10 mass % of a powder deviating from the desired particle size would not have any influence.

Experimental Example 3

Particle size-adjusted powders were produced by using diffusion sources shown in Table 3, PVA (polyvinyl alcohol) as a binder, and NMP (N-methyl-pyrrolidone) as a solvent. However, sample No. 10 was not subjected to granulation with the binder. The particle size-adjusted powders having been produced were allowed to adhere to the same sintered R-T-B based magnet raw piece as that of Experimental Example 1, under conditions shown in Table 3. These were observed and evaluated by a method similar to that of Experimental Example 1, which revealed that each particle size-adjusted powder had adhered uniformly in one layer to the sintered R-T-B based magnet raw piece, while leaving substantially no spaces.

Furthermore, these were subjected to a heat treatment according to the heat treatment temperatures and times shown in Table 3, thus allowing the elements in the diffusion source to diffuse into the sintered R-T-B based magnet raw piece. From a central portion of the sintered R-T-B based magnet after the heat treatment, a cube which was 4.5 mm thick×7.0 mm wide×7.0 mm long was cut out, and its coercivity was measured. $\Delta H_{cJ}$ values, as obtained by subtracting the coercivity of the sintered R-T-B based magnet raw piece from the measured coercivity, are shown in Table 3. For all of these sintered R-T-B based magnets, it was confirmed that coercivity had greatly improved.

TABLE 3

| No. | diffusion source | particle size of particle size-adjusted powder (μm) | adhered amount of RH (mass %) | heat treatment temperature × time | $\Delta H_{cJ}$ (kA/m) |
|---|---|---|---|---|---|
| 1 | $TbF_3$:$Nd_{70}Cu_{30}$ = 4:6 | 150-300 | 1.25 | 900° C.-8 hr | 750 |
| 2 | $TbF_3$:$Nd_{70}Cu_{30}$ = 3:7 | 150-300 | 0.95 | 900° C.-8 hr | 745 |
| 3 | $TbF_3$:$Nd_{70}Cu_{30}$ = 5:5 | 150-300 | 1.48 | 900° C.-8 hr | 752 |
| 4 | $TbF_3$:$Nd_{70}Cu_{30}$ = 4:6 | 106-300 | 0.73 | 900° C.-8 hr | 703 |
| 5 | $TbF_3$:$Nd_{70}Cu_{30}$ = 4:6 | 150-500 | 1.50 | 900° C.-8 hr | 755 |
| 6 | $DyF_3$:$Nd_{80}Cu_{20}$ = 4:6 | 150-300 | 1.00 | 900° C.-8 hr | 510 |
| 7 | $TbF_3$:$Nd_{80}Co_{20}$ = 2:8 | 150-300 | 1.10 | 900° C.-8 hr | 732 |
| 8 | $TbF_3$:$Pr_{68}Cu_{32}$ = 2:8 | 150-300 | 1.20 | 900° C.-8 hr | 755 |
| 9 | $TbF_3$:$Nd_{55}Pr_{15}Cu_{30}$ = 2:8 | 150-300 | 1.04 | 900° C.-8 hr | 747 |
| 10 | DyFe only no granulation with binder) | 106-150 | 1.15 | 900° C.-8 hr | 530 |
| 11 | $TbF_3$ only | 106-150 | 1.4 | 900° C.-12 hr | 382 |

Experimental Example 4

A sintered R-T-B based magnet was produced by a method similar to that of Experimental Example 1. By machining this, a sintered R-T-B based magnet raw piece sized 4.9 mm thick×7.5 mm wide×40 mm long was obtained. Magnetic characteristics of the resultant sintered R-T-B based magnet raw piece were measured with a B-H tracer, which indicated an $H_{cJ}$ of 1023 kA/m and a $B_r$ of 1.45 T.

Next, an $Nd_{30}Pr_{10}$ $_{T}b_{30}Cu_{30}$ alloy was produced through atomization, thereby providing a particle size-adjusted powder (powder of RHRLM1M2 alloy). The particle size-adjusted powder was a spherical powder. The particle size-adjusted powder was subjected to screening, thus being classified into the following four: particle sizes of 38 μm or less, 38 to 106 μm, 106 μm to 212 μm or less, and 106 μm or less (i.e., anything 106 μm or less was not eliminated).

Next, an adhesive agent was applied to the sintered R-T-B based magnet raw piece by a method similar to that of Experimental Example 1.

Figure 6:
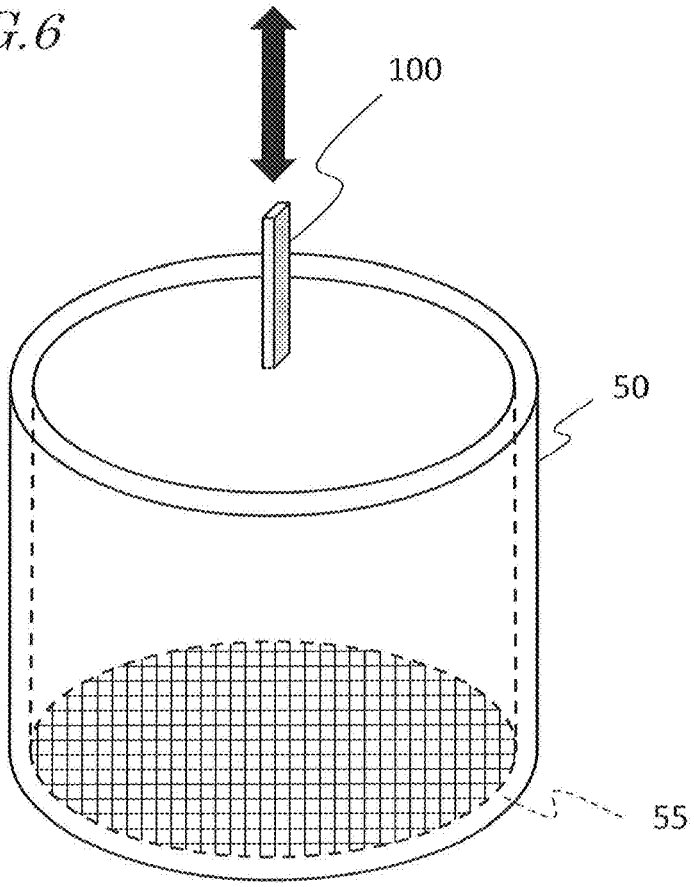
FIG. 6 A diagram schematically showing a process chamber in which a fluidized-bed coating method is performed.

Next, the particle size-adjusted powder was allowed to adhere to the sintered R-T-B based magnet raw piece having the adhesive agent applied thereto. As the method of adhesion, a fluidized-bed coating method was used. A process chamber 50 in which the fluidized-bed coating method was carried out is schematically shown in FIG. 6. This process chamber has a generally cylindrical shape with an open top, with a porous partition 55 at the bottom. The process chamber 50 used in the experiment had an inner diameter of 78 mm and a height of 200 mm, while the partition 55 had an average pore diameter of 15 μm and a porosity of 40%. The particle size-adjusted powder was placed inside the process chamber 50, to a depth of about 50 mm. From below the porous partition 55, atmospheric air was injected into the process chamber 50 at a flow rate of 2 liters/min, thereby allowing the particle size-adjusted powder to flow. The flowing powder came to a height of about 70 mm. The sintered R-T-B based magnet 100 having the adhesive agent adhering thereto was fixed with a clamp jig not shown, and was immersed in the flowing particle size-adjusted powder ($Nd_{30}Pr_{10}$ $_{T}b_{30}Cu_{30}$ alloy powder) for 1 second and then retrieved, thus allowing the particle size-adjusted powder to adhere to the sintered R-T-B based magnet 100. Note that the jig fixed the magnet at two points of contact on both sides of a 4.9 mm×40 mm face of the magnet, and was immersed in such a manner that the 4.9 mm×7.5 mm faces with the narrowest geometric area were situated as top and bottom faces.

Moreover, with respect to samples whose particle size-adjusted powder had a particle size of 38 to 106 μm, the thickness of the sintered R-T-B based magnet raw piece having the particle size-adjusted powder adhering thereto, in the 4.9 mm direction, was measured. The positions of measurement were identical to those in Experimental Example 1; measurements were taken at the three places, i.e., positions 1, 2 and 3 shown in FIG. 4 (N=25 each). The values of increase from the sintered R-T-B based magnet raw piece before the particle size-adjusted powder adhered thereto (i.e., values ascribable to increases on both faces) are shown in Table 4. The values were almost identical among the three places, with hardly any variation in thickness depending on the measurement point. Moreover, samples whose particle size-adjusted powder had a particle size of 106 μm or less were also similarly measured, which indicated that the values were almost identical among the three places, with hardly any variation in thickness depending on the measurement point. This is because, since the fluidized-bed coating method was used as the method of adhesion, the particle size-adjusted powder uniformly adhered to the sintered R-T-B based magnet, rather than the finer powder adhering first to the sintered R-T-B based magnet raw piece.

For samples whose particle size-adjusted powder had a particle size of 38 to 106 μm or that of 106 μm or less, the sintered R-T-B based magnet raw piece having the particle size-adjusted powder adhering thereto was observed with a stereomicroscope, which revealed that, similarly to the 150-300 μm sample in Experimental Example 1, the particle size-adjusted powder had adhered uniformly in one layer to the surface of the sintered R-T-B based magnet raw piece, and that the particles 30 composing the particle size-adjusted powder had densely adhered so as to form one layer (particle layer). It was also confirmed that the samples whose particle size-adjusted powder had a particle size of 38 to 106 μm or that of 106 μm or less satisfied: (1) a plurality of particles being in contact with the surface of the adhesive layer 20; (2) a plurality of particles adhering to the surface of the sintered R-T-B based magnet 100 via nothing but the adhesive layer 20; and (3) other particles sticking to one or more particles among the plurality of particles not via any adhesive material, in accordance with the present disclosure.

TABLE 4

| position of | increase in thickness after adhesion (μm/2 faces) | | |
|---|---|---|---|
| measurement | max | min | average |
| 1 | 203 | 159 | 184 |
| 2 | 190 | 172 | 178 |
| 3 | 198 | 168 | 180 |

Furthermore, what was obtained by subtracting the mass of the sintered R-T-B based magnet raw piece before the particle size-adjusted powder adhered thereto from the mass of the sintered R-T-B based magnet raw piece having the particle size-adjusted powder adhering thereto was defined as a mass of the particle size-adjusted powder; from this value, a Tb amount (mass %) that had adhered, relative to the magnet mass, was calculated.

The calculated values of adhered amounts of Tb are shown in Table 5. From the results of Table 5, the particle size-adjusted powders having a particle size of 38 to 106 μm or that of 106 μm or less had their adhered amounts of Tb being in the range from 0.6 to 1.4 mass %, thus allowing for most efficient adhesion of Tb. Any particle size-adjusted powder having a particle size of 38 μm or less had too small a particle size to result in an adequate adhered amount of Tb with a mere adhesion of approximately one layer. On the other hand, any particle size-adjusted powder which was greater than 106 to 212 μm had too large an adhered amount, thus wasting Tb. From the above experiment, it was indicated that, through controlling the particle size of the particle size-adjusted powder, an RH-containing powder can be allowed to adhere to the magnet surface efficiently and uniformly.

TABLE 5

| particle size of particle | adhered amount of Tb (mass %) | | |
|---|---|---|---|
| size-adjusted powder (μm) | max | min | average |
| 38 μm or less | 0.46 | 0.40 | 0.43 |
| 38-106 μm | 1.11 | 1.02 | 1.05 |
| 106-212 μm | 2.30 | 2.01 | 2.12 |
| 106 μm or less | 0.83 | 0.72 | 0.80 |

Experimental Example 5

A sintered R-T-B based magnet was produced by a method similar to that of Experimental Example 1. By machining this, a sintered R-T-B based magnet raw piece sized 4.9 mm thick×7.5 mm wide×40 mm long was obtained. Magnetic characteristics of the resultant sintered R-T-B based magnet raw piece were measured with a B-H tracer, which indicated an $H_{cJ}$ of 1023 kA/m and a $B_r$ of 1.45 T. By a method similar to that of Experimental Example 4, except for resulting in compositions indicated as Nos. 12 to 16 in Table 6, particle size-adjusted powders (RHRLM1M2 alloy) were provided. Furthermore, these were subjected to a heat treatment according to the heat treatment temperatures and times shown in Table 7 by a method similar to that of Experimental Example 4, thus allowing the elements in the diffusion source to diffuse into the sintered R-T-B based magnet raw piece. Note that the particle size of the particle size-adjusted powder was adjusted so as to result in the adhered amounts of RH shown in Table 7. From a central portion of the sintered R-T-B based magnet after the heat treatment, a cube which was 4.5 mm thick×7.0 mm wide×7.0 mm long was cut out, and its coercivity was measured. $\Delta H_{cJ}$ values, as obtained by subtracting the coercivity of the sintered R-T-B based magnet raw piece from the measured coercivity, are shown in Table 7. As indicated by Table 7, it was confirmed that coercivity had greatly improved for adhered amounts of RH being in the range of 0.6 to 1.5.

TABLE 6

| | RHRLM1M2 alloy composition (at %) | | | | |
|---|---|---|---|---|---|
| No. | Nd | Pr | Tb | Dy | Cu |
| 12 | 60 | | 10 | | 30 |
| 13 | 40 | | 30 | | 30 |
| 14 | 30 | 10 | 30 | | 30 |
| 15 | 40 | | 40 | | 20 |
| 16 | 50 | | | 25 | 25 |

TABLE 7

| RHRLM1M2 alloy No. | adhered amount of RH (mass %) | heat treatment temperature × time | ⊿HcJ |
|---|---|---|---|
| 12 | 0.71 | 900-8 Hr | 710 |
| 13 | 0.98 | 900-8 Hr | 760 |
| 14 | 1.12 | 900-8 Hr | 765 |
| 15 | 1.38 | 900-8 Hr | 770 |
| 16 | 1.05 | 900-8 Hr | 520 |
| 14 | 0.40 | 900-8 Hr | 620 |
| 14 | 0.60 | 900-8 Hr | 725 |
| 14 | 0.80 | 900-8 Hr | 750 |

TABLE 7-continued

| RHRLM1M2 alloy No. | adhered amount of RH (mass %) | heat treatment temperature × time | ⊿HcJ |
|---|---|---|---|
| 14 | 1.00 | 900-8 Hr | 755 |
| 14 | 1.50 | 900-8 Hr | 765 |

INDUSTRIAL APPLICABILITY

Embodiments of the present invention can improve $H_{cJ}$ of a sintered R-T-B based magnet with less of a heavy rare-earth element RH, and therefore may be used in producing a rare-earth sintered magnet for which a high coercivity is expected. Moreover, the present invention is also broadly applicable to techniques in which metallic elements other than heavy rare-earth elements RH need to diffuse into a rare-earth sintered magnet through its surface.

REFERENCE SIGNS LIST

20 adhesive layer
30 powder particles composing the particle size-adjusted powder
100 sintered R-T-B based magnet
100*a* upper face of sintered R-T-B based magnet
100*b* side face of sintered R-T-B based magnet
100*c* side face of sintered R-T-B based magnet

The invention claimed is:

1. A method for producing a sintered R-T-B based magnet, comprising:

a step of providing a sintered R-T-B based magnet (where R is a rare-earth element; and T is Fe, or Fe and Co);

a step of providing a diffusion source powder that is composed of a powder of an alloy or a compound of a heavy rare-earth element RH which is at least one of Dy and Tb;

an application step of applying an adhesive agent to an application area of a surface of the sintered R-T-B based magnet, the adhesive agent being a layer having a thickness of not less than 10 μm and not more than 100 μm;

an adhesion step of using a fluidized-bed coating method to allow the diffusion source powder to adhere to the application area of the surface of the sintered R-T-B based magnet having the adhesive agent applied thereto;

a diffusing step of heating the sintered R-T-B based magnet having the diffusion source powder adhering thereto at a temperature which is equal to or lower than a sintering temperature of the sintered R-T-B based magnet to allow the heavy rare-earth element RH contained in the diffusion source powder to diffuse from the surface into the interior of the sintered R-T-B based magnet.

2. The method for producing a sintered R-T-B based magnet of claim 1, wherein, in the adhesion step, the diffusion source powder is allowed to adhere to the application area so that the amount of heavy rare-earth element RH contained in the diffusion source powder is in a range from 0.6 to 1.5% with respect to the sintered R-T-B based magnet by mass ratio.

3. The method for producing a sintered R-T-B based magnet of claim 2, wherein, in the adhesion step, the diffusion source powder is allowed to adhere to the application area so that the amount of heavy rare-earth element RH contained in the diffusion source powder is in a range from 0.7 to 1.5% with respect to the sintered R-T-B based magnet by mass ratio.

4. The method for producing a sintered R-T-B based magnet of claim 1, wherein the sintered R-T-B based magnet includes:

rare-earth element R: 12 to 17 at %;

B ((boron), part of which may be replaced with C (carbon)): 5 to 8 at %;

additive element(s) M' (at least one selected from the group consisting of Al, Ti, V, Cr, Mn, Ni, Cu, Zn, Ga, Zr, Nb, Mo, Ag, In, Sn, Hf, Ta, W, Pb and Bi): 0 to 2 at %; and T (transition metal element, which is mainly Fe and may include Co) and inevitable impurities: balance.

* * * * *